US009982851B2

(12) United States Patent
Parsons

(10) Patent No.: US 9,982,851 B2
(45) **Date of Patent: *May 29, 2018**

(54) FLASHLIGHT WITH USB CHARGER

(71) Applicant: Armament Systems and Procedures, Inc., Appleton, WI (US)

(72) Inventor: Kevin Parsons, Appleton, WI (US)

(73) Assignee: ARMAMENT SYSTEMS AND PROCEDURES, INC., Appleton, WI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/082,663

(22) Filed: Mar. 28, 2016

(65) Prior Publication Data

US 2016/0208992 A1 Jul. 21, 2016

Related U.S. Application Data

(60) Continuation of application No. 14/513,857, filed on Oct. 14, 2014, now Pat. No. 9,316,366, which is a (Continued)

(51) Int. Cl.
*F21L 13/00* (2006.01)
*F21L 4/08* (2006.01)
(Continued)

(52) U.S. Cl.
CPC ..... *F21L 4/085* (2013.01); *F21L 4/005* (2013.01); *F21V 23/005* (2013.01);
(Continued)

(58) Field of Classification Search
CPC ..... F21Y 2101/02; F21L 4/08; F21L 4/027
(Continued)

(56) References Cited

U.S. PATENT DOCUMENTS

2006/0250787 A1* 11/2006 Ho ..... F21L 4/005 362/118
2013/0343042 A1* 12/2013 Windom ..... F21L 4/08 362/183

FOREIGN PATENT DOCUMENTS

CN 201606666 10/2010

OTHER PUBLICATIONS

NexTorch myToch (18650) Review, www.lightreviewers.com Dec. 29, 2015 (21 pages).

(Continued)

*Primary Examiner* — Vip Patel
(74) *Attorney, Agent, or Firm* — Hahn Loeser & Parks LLP

(57) ABSTRACT

A flashlight is provided. The flashlight includes a frame defined by a rail that extends around a central opening predominantly within a single plane, a mounting loop extending outboard of the frame on a first end, a planar circuit board disposed within the central opening. The plane of the circuit board coincident with the plane of the frame, an LED light disposed on the circuit board, where a light emitting end of the LED light extending through the frame on a second end of the frame opposite the first end. A rechargeable battery is disposed on the circuit board, a switch is provided that couples the battery to the LED light. An actuator of the switch extends through the frame between the first and second ends, a USB connector is disposed on the circuit board, the USB connector extends through the frame between the first and second ends and a battery charger is disposed on the circuit board that charges the battery via energy received through the USB connector.

8 Claims, 7 Drawing Sheets

Related U.S. Application Data division of application No. 13/562,570, filed on Jul. 31, 2012, now Pat. No. 8,888,311.

(51) Int. Cl.

| | |
|---|---|
| ***F21L 4/00*** | (2006.01) |
| ***F21V 23/00*** | (2015.01) |
| ***F21V 23/04*** | (2006.01) |
| ***F21V 23/06*** | (2006.01) |
| *F21W 111/10* | (2006.01) |
| *F21Y 115/10* | (2016.01) |

(52) U.S. Cl.
CPC ..... *F21V 23/0407* (2013.01); *F21V 23/0414* (2013.01); *F21V 23/06* (2013.01); *F21W 2111/10* (2013.01); *F21Y 2115/10* (2016.08)

(58) Field of Classification Search
USPC ..... 362/183, 184, 652
See application file for complete search history.

(56) References Cited

OTHER PUBLICATIONS

NexTorch myTorch (18650) Review; http://fightreviewers.com Jun. 21, 2017; (19 pages).

* cited by examiner

FLASHLIGHT WITH USB CHARGER

RELATED APPLICATIONS

This Application is a continuation patent application of and claims priority to U.S. patent application Ser. No. 14/513,857 filed Oct. 14, 2014 (currently pending); which is a divisional of U.S. patent application Ser. No. 13/562,570 filed Jul. 31, 2012, issued on Nov. 18, 2014 as U.S. Pat. No. 8,888,311.

FIELD

The field relates to flashlights and more particularly to rechargeable flashlights.

BACKGROUND

Conventional, general purpose flashlights may be used by civilians, police and the military and have a variety of uses. In the civilian context, flashlights are very useful in power outages or for finding things in dark areas of the home.

Small flashlights (capable of being carried on a key ring) are very useful in the context of travel. In this regard, a small key ring flashlight may be used by a driver to find the keyhole on a door lock of a car at night or to insert the car key into the ignition switch.

Key ring flashlights are also very useful in the context of security. For example, a woman returning to her car parked in a dark area may use the flashlight to look for criminals hiding in a back seat before entering her car.

Flashlights are also very useful to the police. In this regard, a flashlight may be used by a police officer to illuminate the interior of a car during a traffic stop. Such devices may also be used by a police officer to adjust his/her equipment, to send coded signals to other officers, to illuminate dark alleys or stairs or to facilitate searches of poorly lit areas.

However, the size and weight of conventional flashlights add to the inconvenience and reduce the mobility of law enforcement personnel who are often required to carry such flashlights along with other law enforcement equipment. Sometimes a flashlight may be purposely or inadvertently left behind where an officer removes equipment while in his/her car or on break in order to reduce weight and the fatigue associated with carrying such weight. This can place the safety of the officer in jeopardy when a need for the flashlight arises and the flashlight cannot be located on the person or is not readily available.

The same is true for military personnel. However, in the case of military personnel, the problem is compounded because of the need to operate independently for extended time periods without resupply.

In addition to flashlights, both police and the military are often required to carry data processing and transmission equipment. Such equipment may be necessary in order to allow police officers to research warrants or for military personnel to download maps.

Another problem for police and the military is the need for spare batteries for flashlights and data processing devices. In many cases, the weight of the spare batteries may equal or exceed the weight of the devices in which the batteries are used.

Thus, there is a need for a compact, lightweight flashlight that may be easily carried on the person of the civilian, police or members of the military and that reduces the need for spare batteries. The flashlight should be conveniently attached to one's key chain or carried on one's clothing to help ensure that the flashlight remains in the user's possession and can be easily retrieved when needed.

DETAILED DESCRIPTION OF AN ILLUSTRATED EMBODIMENT

Figure 1:
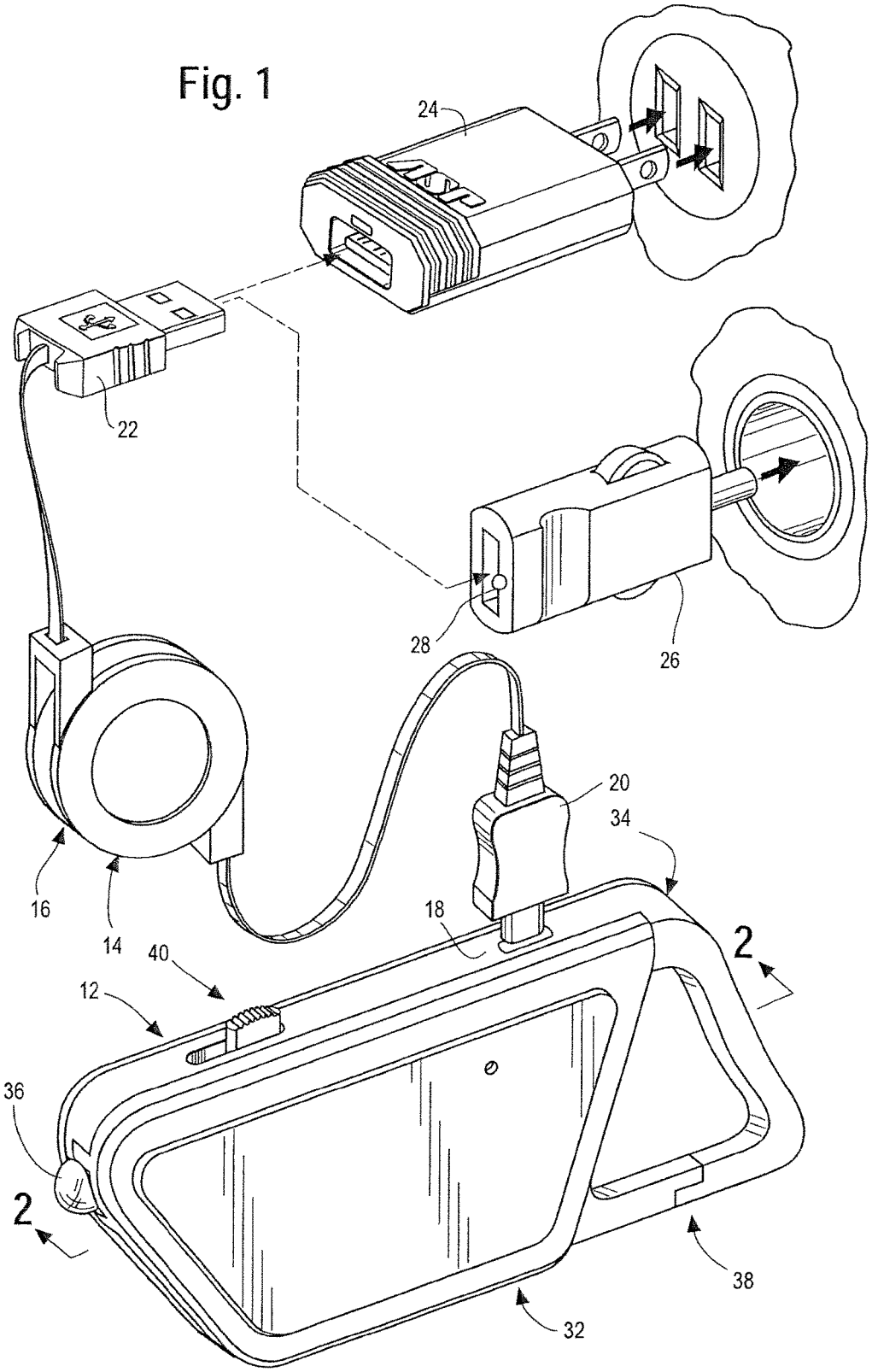
FIGS. 1 and 1A are perspective views of a rechargeable flashlight system shown generally in accordance with an illustrated embodiment.
Figure 1A:
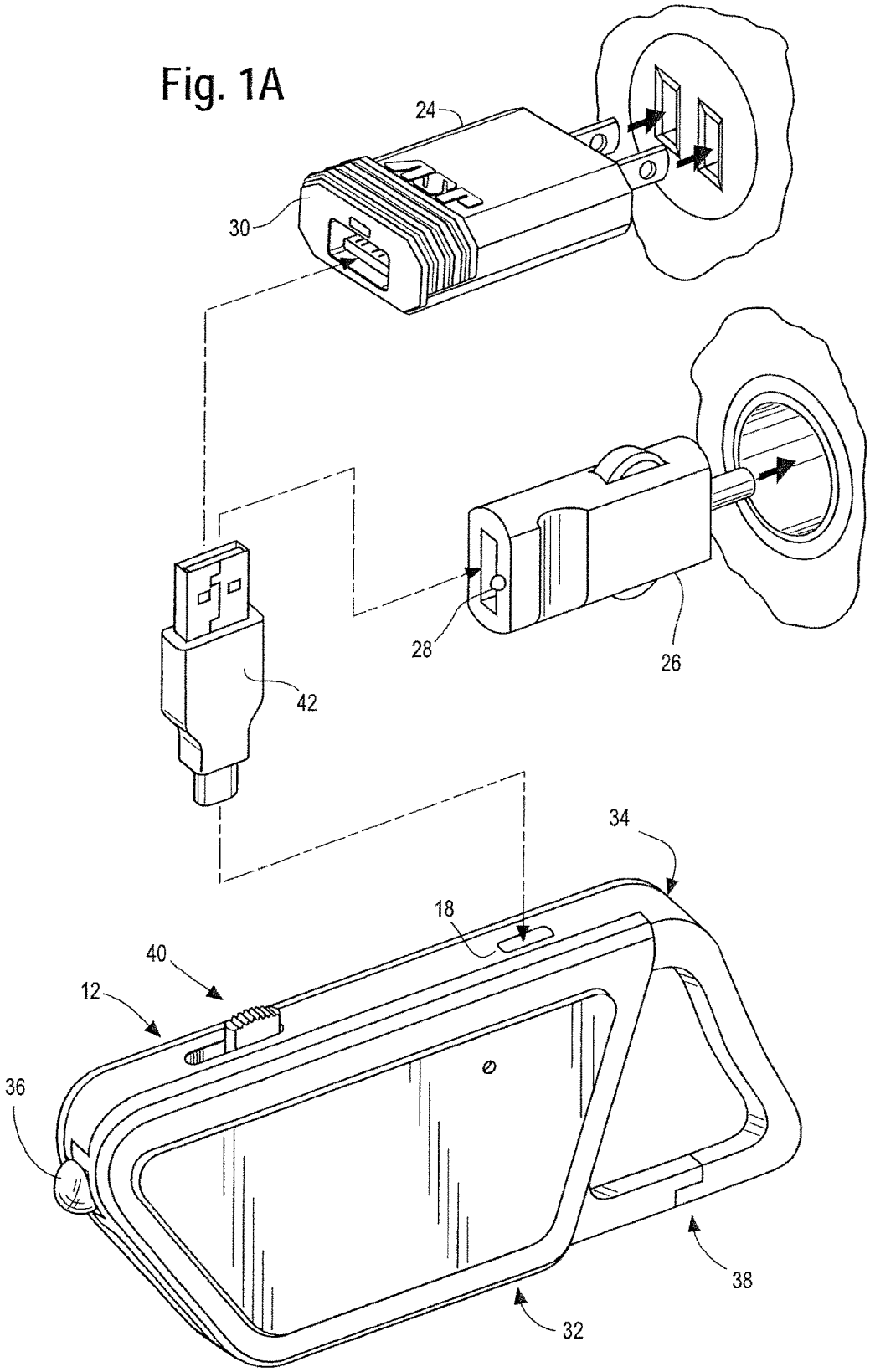

FIGS. 1 and 1A are perspective views of a flashlight system 10 shown generally in accordance with an illustrated embodiment. Included within the flashlight system 10 is a rechargeable flashlight 12 and a charging system 14. In this regard, the flashlight system 10 differs from prior art flashlights in its structure and adaptability to any of a number different operating environments.

Figure 9:
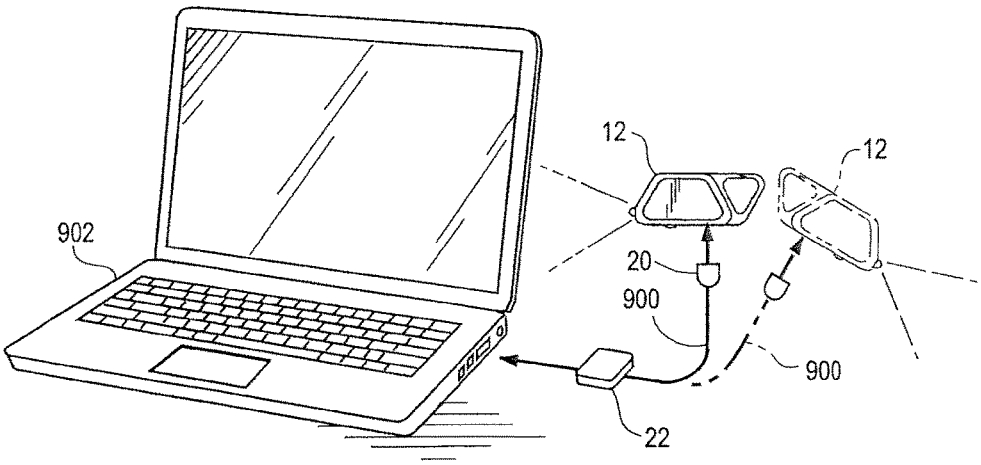
FIG. 9 is a perspective view of the flashlight of FIG. 1 supported from a laptop by a USB connector cable.

For example, the flashlight system 10 is provided with a flexible USB to micro USB connector 16. The USB to micro USB connector 16 has a conventional USB plug 22 on one end and a micro USB plug 20 on the other end. A micro USB receptacle 18 on the flashlight 12 allows the flashlight 12 to be recharged by simply connecting the flashlight 12 to a conventional USB outlet of a laptop or other computer (FIG. 9).

Alternatively, the USB to micro USB connector 16 may be used to charge the flashlight 12 via other power sources. For example, the USB connector 16 and plug 22 may be used in conjunction with a wall adapter 24 that receives conventional alternating current (110 vac) or a cigar lighter adapter 26 that receives direct current (12 vdc) from an automobile. In either case, a power-on indicator light 28, 30 may be used to indicate that power is available from the adapter 24, 26 to charge the flashlight 12 via the connector 16.

A USB to micro USB adapter plug 42 may also be used in place of the USB to micro USB connector 16 as shown in FIG. 1A. The adapter 42 can be used in the same way as the connector 16, but has the advantage of being more compact.

In general, the flashlight 12 has a generally flat housing having substantially greater longitudinal length that thickness to define laterally opposing side and edge surfaces 32, 34. In this regard, a light emitting diode (LED) 36 may be provided on an edge surface 34 and on a first end of the flashlight 12. A mounting loop 38 may be provided on a second, opposing end of the flashlight 12.

Located between the first and second ends of the flashlight 12 may be a switch 40 and the micro USB receptacle 18. In this regard, the switch 40 is designed to be completely ambidextrous in its functionality so that it is equally easy to use by left-handed or right-handed people.

Figure 4:
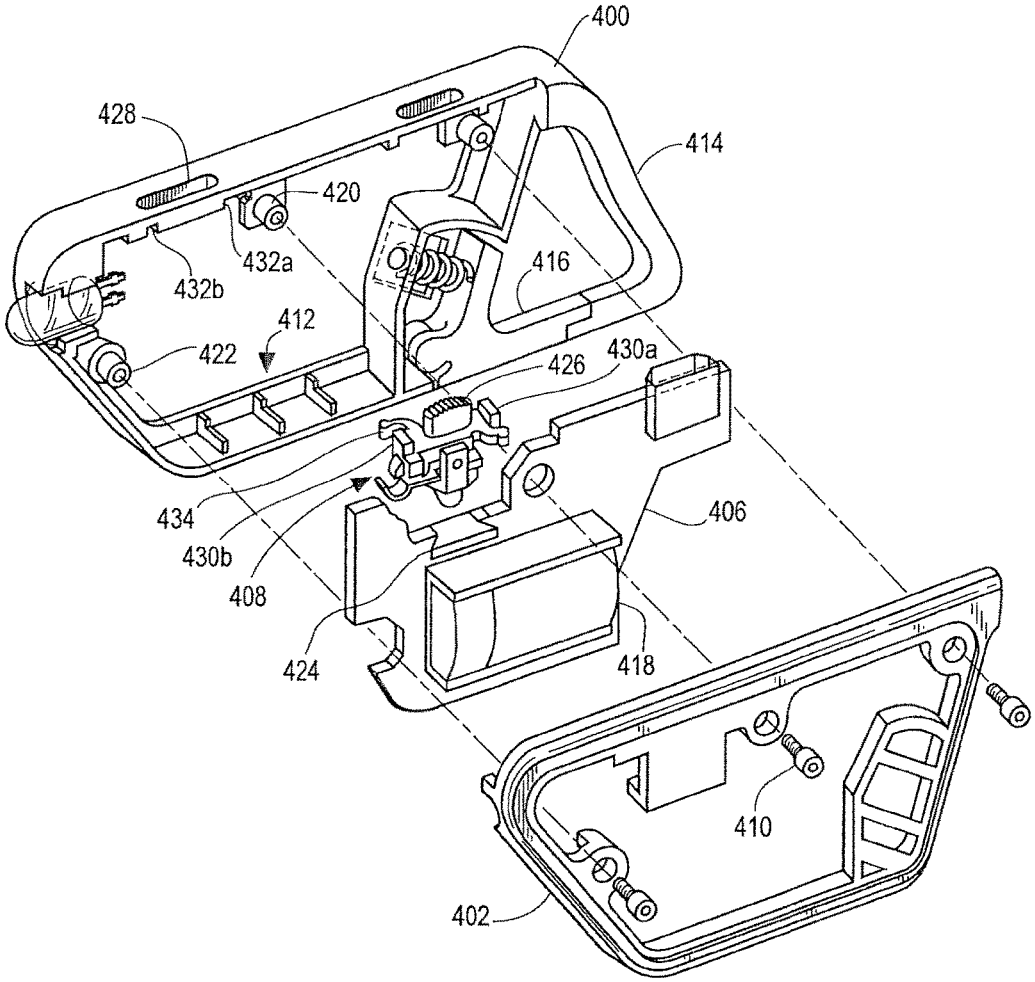
FIG. 4 is an exploded view of the flashlight of FIG. 1.

FIG. 4 is an exploded view of the light 12 of FIG. 1. As shown in FIG. 4, the flashlight 12 includes a frame 400, a printed circuit board (PCB) 406 that fits inside the frame 400, a switch carrier 408 and a cover 402. The frame cover 402 may be secured to the frame via one or more screws 410.

Figure 6:
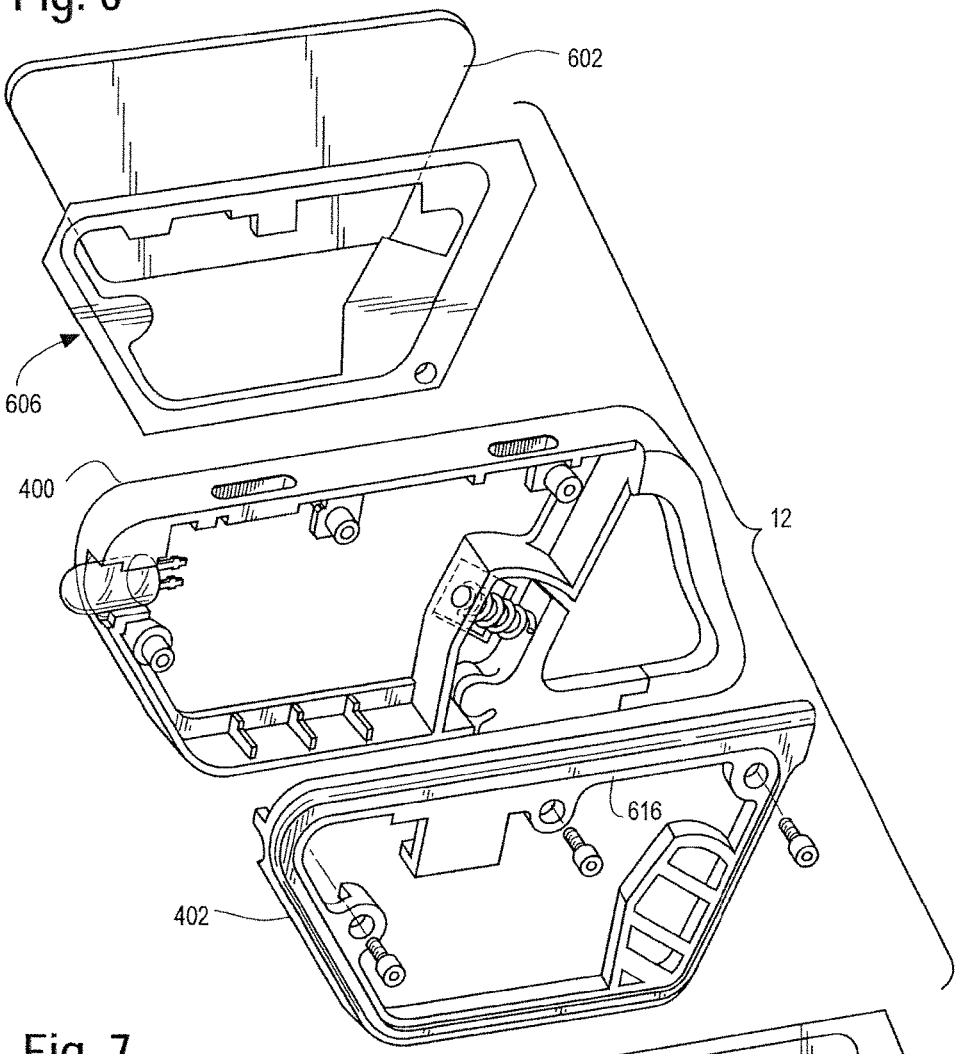
FIG. 6 is a detailed exploded view of the flashlight of FIG. 1.

A more detailed exploded view of the flashlight 12 is shown in FIG. 6. As may be observed from FIG. 6, a pair of panels 602, 604 may be attached to the longitudinal sides of the frame 400 and cover 402 to close off the openings in the housing and cover and to further protect the circuit board 406 from contaminants. In this regard, the panels 602, 604 may be placed in a recess 616 that extends around the openings and attached to the flashlight 12 via a layer 606, 608 of an adhesive. In one particular embodiment, the adhesive 606, 608 may be double-sided tape, cut to the precise size of the frame 400, the cover 402 and panels 602, 604 and that is initially provided with a peel-off protective cover 610 on both opposing sides. In this regard, the panels 602, 604 may be attached by removing the protective covers 610 and attaching the panel to the cover or frame.

In general, the flashlight 12 is constructed to be extremely rugged with an extraordinary resistance to shock. In this regard (and as shown in FIGS. 4 and 6), the frame 400 is defined by a reinforced rail 412 that extends around a central opening, predominantly within a single plane. The mounting loop 38 is outboard of the central opening. In this regard, the mounting loop 38 includes a first portion 414 integral with the rail 412 and a second moveable portion 416. The frame 400 (defined by the rail 412 and portion 414) are further defined by a single piece of die cast or machined metal.

Figure 5:
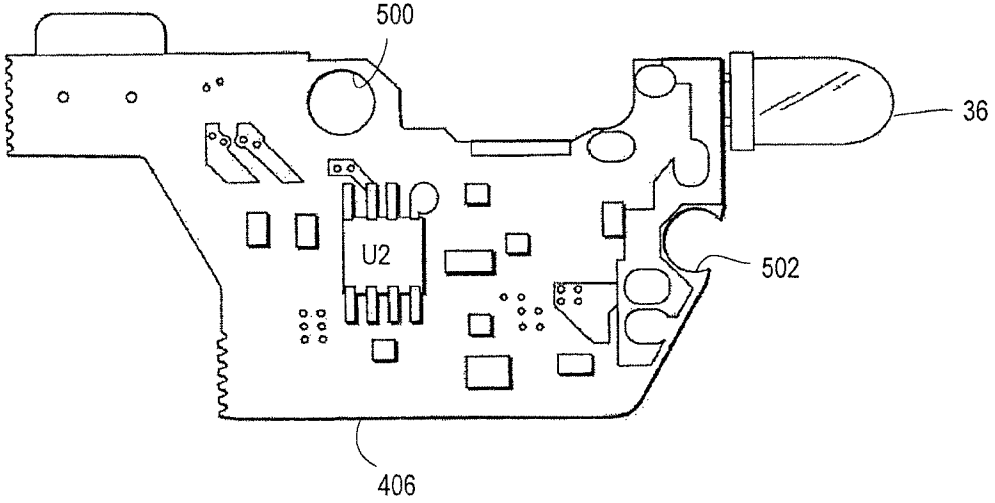
FIG. 5 is a side view of a circuit board from the flashlight of FIG. 1.

Consistent with the extreme durability of the frame 400, the PCB 406 is constructed to support the LED light 36, the USB receptacle 18, a rechargeable battery 418 and associated circuitry. The PCB 406 is rigidly supported by (and within) the frame 400 via a set of apertures 500, 502 (FIG. 5), that engage a set of posts 420, 422 (FIG. 4).

Figure 8:
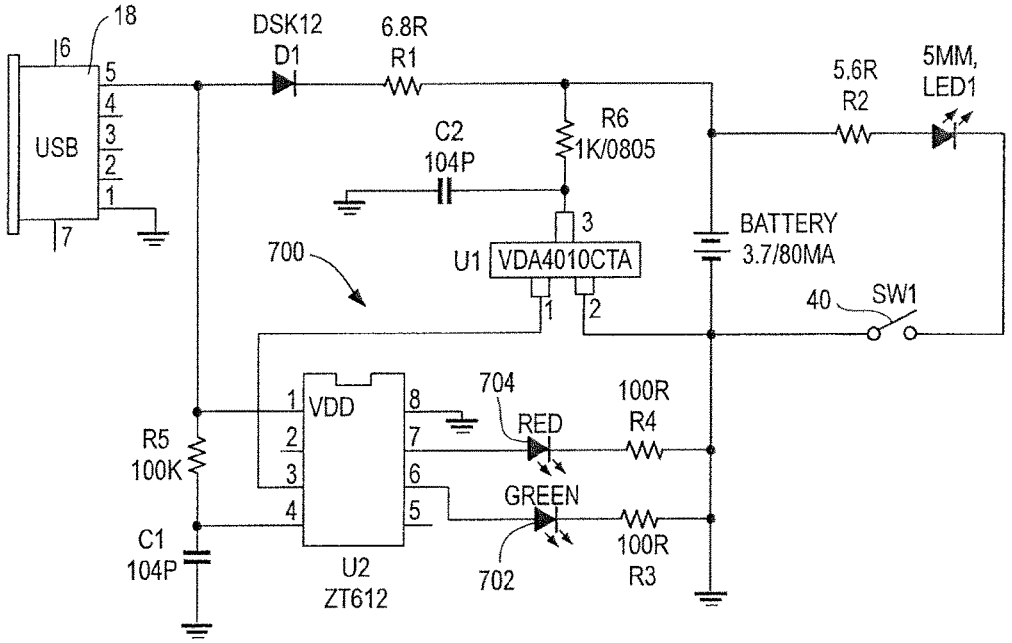
FIG. 8 is a circuit diagram of the flashlight of FIG. 1.

The battery 418 may be a lithium polymer battery 418 selected for its high energy density to weight ratio. FIG. 8 is a circuit diagram of the flashlight 12 including the battery 418 and associated circuitry.

As shown in FIG. 8, the battery 418 is coupled to the LED light 36 via resistor R2 and a switch SW1 comprising the switch carrier 408. Electrical energy received through the USB receptacle 18 is coupled to the battery 418 via a diode D1 and resistor R1.

Also included on the PCB is a charging indicator circuit 700. A charge status circuit U2 detects a battery voltage via a detection circuit U1 and provides an indication of charge state via one of a red LED light 704 or green LED light 702. In this regard, the red LED light 704 is programmed to flash when the battery is charging. When the battery achieves a full charge, the red LED 704 is extinguished and the green LED light 702 displays a steady green color. The use of a flashing red light and steady green light is provided so that color blind people would not be confused as to the charge status.

The switch carrier 408 of the switch 40 is designed to float within a designated space between the frame 400 and a flat plate 424 rigidly mounted to the PCB 406 and to move in two different directions. The flat plate 424 operates as part of the switch 40 and is electrically connected directly to the battery as shown in FIG. 8.

Figure 2:
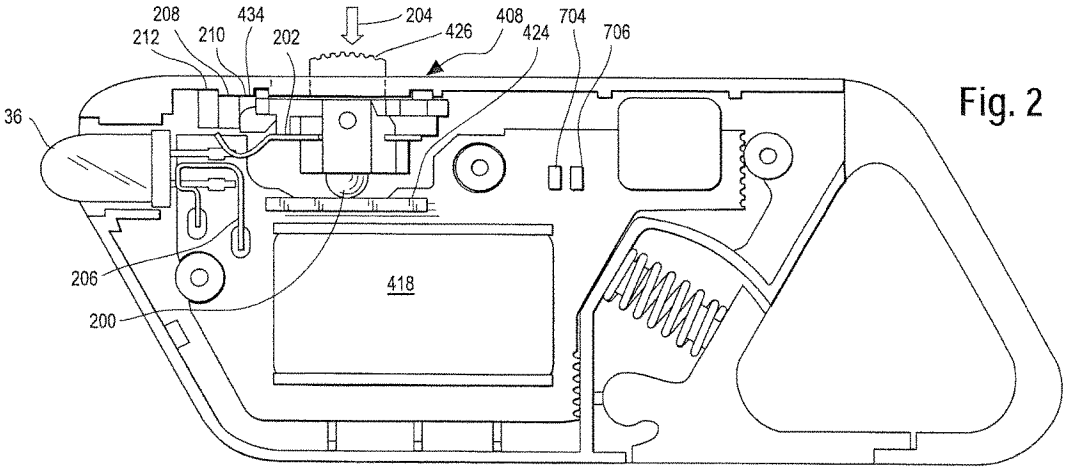
FIG. 2 is a cut-away view of the flashlight of FIG. 1.

A mechanical actuator 426 (FIG. 4) of the switch 40 extends through an elongated aperture 428 along a top edge of the frame 400. In this regard, a spring loaded electrical contact 200 (FIG. 2) on a bottom of the switch carrier 408 engages the flat plate 424 thereby urging the switch carrier 408 upwards against a portion of the frame 400 surrounding the aperture 428. The actuator 426 and body of the switch carrier 408 are generally constructed of an insulating material such as plastic.

Extending from the switch carrier 408 is a second electrical contact 202 (FIG. 2) that is, in turn, electrically connected (within the switch carrier 408) to the spring loaded contact 200. The second electrical contract 202 extends laterally from the switch carrier 408 parallel to the portion of the frame 400 adjacent the aperture 428. The spring loaded contact 200 and second electrical contact 202 form the electrical circuit of the switch SW1 shown in FIG. 8.

The switch SW1 may be closed by two related movements of the actuator. In this regard, a user of the light 12 may depress the actuator 426 straight downwards as shown by arrow 204 in FIG. 2 or may depress the actuator 426 downwards and slide the actuator laterally towards the LED light 36 as shown by arrow 206 in FIG. 3.

In the first case, where the actuator is moved downwards (as shown by arrow 204), the second contact 202 makes electrical contract with a third contact 206. In the second case where the actuator is moved downwards and slid towards the LED (as shown by arrow 206), the second contact 202 also makes contact with the third contact 206. The difference between the first and second cases is that the first case provides a momentary electrical contact and the second case provides a maintained electrical contact. In the second case, the lateral movement towards the LED 36 (after depressing the actuator 426) causes a set of abutments associated with the switch carrier 408 to maintain the switch carrier 408 in the depressed state after the user releases the actuator 426 thereby maintaining the LED 36 in an activated state after release of the actuator 426 by the user.

In this regard, the switch carrier 408 is provided with a set of ridges 430*a*, 430*b* (FIG. 4) on a top surface of the switch carrier 408. A corresponding set of slots 432*a* and 432*b* are provided in the inside surface of the frame 400 adjacent the slot 428 that receive the ridges 430*a*, 430*b*. In the first case of the momentary contact, the rides 430*a*, 430*b* slide out of and back into the slots 432*a*, 432*b* as the actuator 426 is depressed in direction 204 and released.

Figure 3:
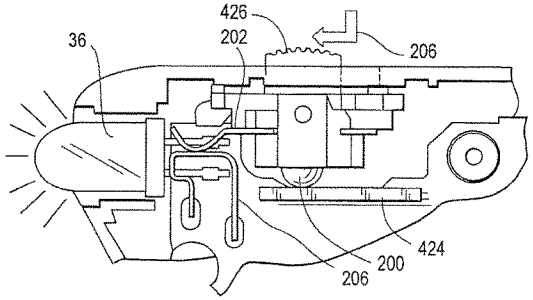
FIG. 3 is a cut-away view of the flashlight of FIG. 1 in an activated state.

In the second case, when the actuator 426 is moved laterally towards the LED 36, the ridges 430*a*, 430*b* are moved out of the slots 432*a*, 432*b* and onto a set of adjacent abutments, thereby maintaining the actuator 426 in the depressed state as shown in FIG. 3 after release by the user. In the second case, when the user wants to extinguish the light 36, the user simply moves the actuator 426 laterally away from the LED 36 and releases the actuator 426 thereby breaking the connection between contacts 202 and 206 as the ridges 430*a*, 430*b* again enter the slots 432*a*, 432*b*.

It should be specifically noted that contacts 200 and 202 make sliding contact with the corresponding stationary contacts. This is important in the reliable operation of the light 12 because the sliding contact abrades away dirt or corrosion that otherwise may interfere with the reliable operation of the flashlight 12.

In order to provide feedback to the user and in order to distinguish between the momentary contact and maintained contact positions, the switch carrier 408 is provided with a detent that provides the user with positive feedback (e.g., a tactile click) as to the lateral position of the actuator 426. In this regard, an arm 434 (FIG. 4) on the switch carrier 408 moves over a ridge 208 (FIG. 2) between pockets 210, 212. When a tip of the arm 434 is in the pocket 210, the switch carrier 408 is in the momentary position. On the other hand, when the tip of the arm 434 is in the pocket 212, the switch carrier 408 is in the maintained contact position.

The panels 602, 604 may be fabricated of any of a number of materials. Exemplary panels may be acrylic, rubberized, stamped or ground metal, anodized metal, diamond cut metal or enamel on metal.

In the case of rubberized panels, the panel 602, 504 may be formed from a metal (e.g., aluminum) shell coated with a rubberized paint (Rubberized Paint Grade HS236). In this case, the rubberized paint may be a chlorinated product with a soft texture that is, warm to the touch and is resistant to slipping within the fingers of the user.

In one embodiment, one or more of the panels 602, 604 may be covered with a rubberized paint on an outside surface and an acrylic paint on an inner surface. In this case, the acrylic paint on the inside surface may be provided with a unique design that is only visible during charging and then only when one of the LEDs 702, 704 is illuminated.

Alternatively, one or more of the panels may be coated with a glow-in-the-dark phosphor paint. This glow-in-the-dark capability may be used to provide a convenient means for locating the flashlight 12 in a dark room.

Alternatively, the outside surfaces of panels 602 may be diamond or laser cut to provide a distinct feel. The distinct feel of one or more side may assist the user in locating the actuator 426 in the dark or differentiating the flashlight from similarly shaped objects in the pocket or purse of a user.

In addition, the panels 602, 604 may be provided under any of a number of different decorative or informative formats. For example, the panels 602, 604 may be imprinted with the name and/or logo of any of a number of different commercial organizations. In this regard, the flashlight 12 of the light system 10 may have significant commercial value when given away or sold at reduced prices as part of a promotional campaign.

Figure 7:
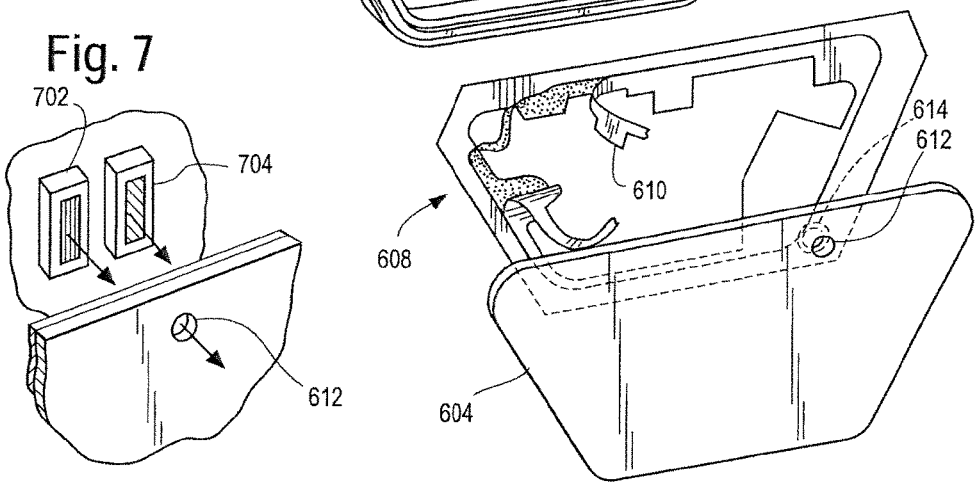
FIG. 7 depicts details of charge state LEDs of FIG. 1.

In addition or alternatively, the panels 602, 604 may be fabricated of any of a number of different transparent, opaque or light blocking materials. Where constructed of a light blocking material, an aperture 612 may be provided adjacent the charge indicating LEDs 702, 704 (as shown in FIG. 7) in order for the user to be able to visually observe the charge state of the rechargeable battery. In addition to the aperture 612, a hemispherical shaped lens 614 may be attached to an inside surface of the cover 604. In this case, the hemispherical shape of the lens 614 operates to collect light from the LEDs 702, 704 inside the frame 400 (and that may be offset from the aperture 612) and focus that light through the aperture 612 for the benefit of the user.

In another embodiment, the USB to micro USB connector 16 may be provided with a self-supporting sheath 900 that is malleable and encloses the conductors extending between plugs 20, 22. The sheath 900 is malleable because it can be easily bent or otherwise deformed along its longitudinal axis into any shape and (once bent) will retain that shape. The sheath 900 has sufficient strength to independently support the flashlight 12 by first inserting the plug 20 into the flashlight 12 and then inserting the plug 22 into some other supporting receptacle (e.g., a laptop 902 as shown in FIG. 9). The position of the flashlight 12 shown in phantom in FIG. 9 shows an example of how the flexible sheath 900 could be twisted in order to allow the light 12 to shine down upon a book next to the laptop 902, yet still support the flashlight 12 above the book.

The sheath 900 may be formed by wrapping a strand of malleable metal (e.g., steel) wire or flattened metal around a mandrel to form a continuous tube that defines the supporting structure of the sheath 900. The tube may then be cut to an appropriate length (e.g., 15 inches).

A set of electrical conducting wires may be inserted through the tube and soldered or otherwise electrically joined to each of the respective set of electrical terminals of the plugs 20, 22. The tube may be joined to the respective plugs 20, 22 to form the finished sheath 900 by overmolding the junction between the tube and plugs 20, 22 with an appropriate material (e.g., plastic.).

The use of the connector 16 with a malleable sheath 900 is important because it allows the flashlight 12 to be directed towards and used to illuminate the keyboard of the laptop 902 (or reading materials adjacent the laptop 902) while the flashlight 12 is being charged. As shown in FIG. 9, the flashlight 12 (and connector 16) is entirely supported via the plug 22 after the plug 22 has been inserted into the USB receptacle of the laptop 902. The flashlight 12 may be used to illuminate materials in other applications and with other devices having a USB receptacle.

For example, the connector 16 (with sheath 900) could be used with the flashlight 12 and the car adapter 26 to illuminate a map in an automobile. In this case, the flashlight 12, connector 16 and adapter 26 would be supported entirely by the cigar lighter receptacle of the automobile.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A flashlight, comprising:

a. a housing;

b. a rechargeable battery disposed within the housing;

c. a USB receptacle, accessible through an aperture in the housing;

d. a charging circuit comprising a voltage detector circuit coupled to the USB receptacle and to the rechargeable battery, a charge status circuit coupled to the voltage detector circuit, and a plurality of status LEDs, the charge status circuit being configured to drive the plurality of status LEDs to provide both a color based charge status indication and a color-independent charge status indication;

e. a switch, coupled to the rechargeable battery; and f. an LED lamp, actuated by closure of the switch.

2. The flashlight of claim 1 further comprising a lens, and wherein each of the plurality of status LEDs is viewable through the lens.

3. The flashlight of claim 1, wherein the plurality of status LEDs comprises a first status LED and a second status LED, and wherein the charge status circuit is configured to drive the first status LED to flash while the rechargeable battery is being charged and to drive the second status LED to illuminate steadily when the rechargeable battery attains full charge to provide the color independent charge status indication.

4. The flashlight of claim 1, wherein the plurality of status LEDs comprises a first status LED and a second status LED, the first status LED being selected to emit a different color than the second status LED, and wherein the charge status circuit is configured to drive the first status LED to illuminate while the rechargeable battery is being charged and to drive the second status LED to illuminate when the rechargeable battery attains full charge to provide the color based charge status indication.

5. The flashlight of claim 1, wherein the switch is operable in an intermittent contact mode in a first position and a non-intermittent contact mode in a second position.

6. A flashlight, comprising:

a. a housing;

b. a rechargeable battery disposed within the housing;

c. a USB receptacle, accessible through a first aperture in the housing;

d. a plurality of status LEDs viewable through a common lens and second aperture in the housing;

d. a charging circuit coupled to the USB receptacle; the rechargeable battery, and the plurality of status LEDs;

e. a switch operable in an intermittent contact mode in a first position and a non-intermittent contact mode in a second position, coupled to the rechargeable battery; and f. an LED lamp, actuated by closure of the switch.

7. The flashlight of claim 6, wherein the plurality of status LEDs comprises a first status LED and a second status LED, and wherein the charging circuit is configured to drive the first status LED to flash while the rechargeable battery is being charged and to drive the second status LED to illuminate steadily when the rechargeable battery attains full charge.

8. The flashlight of claim 6, wherein the plurality of status LEDs comprises a first status LED and a second status LED, the first status LED being selected to emit a different color than the second status LED, and wherein the charging circuit is configured to drive the first status LED to flash while the rechargeable battery is being charged and to drive the second status LED to illuminate steadily when the rechargeable battery attains full charge to provide both a color based charge status indication and a color-independent charge status indication.

* * * * *